United States Patent [19]

Sullivan et al.

[11] 4,388,071

[45] Jun. 14, 1983

[54] GUM APPLYING APPARATUS

[75] Inventors: John Sullivan, San Jose; Harold R. Lillibridge, Burlingame, both of Calif.

[73] Assignee: Champion International Corporation, Stamford, Conn.

[21] Appl. No.: 324,613

[22] Filed: Nov. 24, 1981

Related U.S. Application Data

[63] Continuation of Ser. No. 129,399, Mar. 20, 1980, abandoned.

[51] Int. Cl.[3] ..... B31B 1/62

[52] U.S. Cl. ..... 493/333; 493/266; 493/337

[58] Field of Search ..... 493/333, 337, 336, 266, 493/277-279, 281, 132; 118/244, 258

[56] References Cited

U.S. PATENT DOCUMENTS

| | | | |
|---|---|---|---|
| 1,193,626 | 8/1916 | Staude | 493/333 |
| 1,926,364 | 9/1933 | Bergstein | 493/337 X |
| 2,088,228 | 7/1937 | Belcher et al. | 493/266 X |
| 2,776,224 | 1/1957 | Cote | 493/337 X |
| 2,953,071 | 9/1960 | Heywood | 493/333 |
| 2,967,465 | 1/1961 | Berenson | 493/337 X |
| 2,986,975 | 6/1961 | Mengis et al. | 493/337 |

*Primary Examiner*—James F. Coan

*Attorney, Agent, or Firm*—Evelyn M. Sommer; John H. Mulholland

[57] ABSTRACT

Gum applying apparatus including a pair of gum applying dies mounted on a common shaft for applying gum along and adjacent to the side edges of an envelope blank during the manufacture of the blank into an envelope. Each of the dies includes a central circular plate and a pair of circular sectors spaced from each other about the circumference of the circular plate. The sectors are in contact with a gummer roll which transfers gum from a container to the sectors. The gum is applied by the sectors to spaced envelope blanks on a conveyor belt beneath the sectors. The space between the sectors is adjacent the conveyor when the space between the blanks on the conveyor traverses the gum applying station thereby precluding gum from being applied to the belt running through the station; but enabling the gum to be applied continually to the envelope blanks. Means are also disclosed to control the amount of gum transferred to the gum applying die sectors.

6 Claims, 4 Drawing Figures

GUM APPLYING APPARATUS

This is a continuation of application Ser. No. 129,399, filed Mar. 20, 1980, and now abandoned.

BACKGROUND OF THE INVENTION

1. Field of the Invention

This invention relates to an apparatus for applying gum or adhesive to an envelope blank during manufacture of an envelope.

2. Description of Related Art

In an application entitled "Apparatus For Manufacturing Envelopes", assigned to the same assignee as the assignee of the present application, Ser. No. 136,493 filed Apr. 3, 1980 now U.S. Pat. No. 4,338,085, an apparatus is disclosed for feeding, scoring, gumming and folding a blank into an envelope. At the gumming station, gum or adhesive is applied along and adjacent to opposite side edges of the envelope blank and then opposed portions of the side edges are folded over the portions of the blank containing the gum or adhesive so as to form the pocket of an envelope enclosure.

The gum or adhesive is applied along and adjacent to the opposite side edges of the envelope blank by rollers which are in engagement with glue transfer rollers, which in turn tangentially contact a gum roller adapted to be immersed in a container containing liquid gum or adhesive. Since the gum applying surface of the gum applying rollers are continuous and form the circumference of each of the rollers, it is difficult to accommodate successive envelope blanks in the apparatus.

If the rollers continuously supply gum or adhesive to the envelope blanks and the blanks are sequentially fed through the gumming station in spaced relation, glue will be applied to the feed belt between the envelope blanks, thereby marring the belt and rendering the apparatus inoperative as successive envelopes will adhere to the belt.

Accordingly, in the aforementioned gumming station of the envelope manufacturing apparatus disclosed, the envelope blanks are fed successively past the gum applying rollers on a conveyor belt. The belt which normally supports the envelope blank is looped beneath the gum applying rollers so that it is out of contact with the rollers at the gum applying station. At the station, the envelope blank is successively supported by the belt, an idler roller as it passes beneath and adjacent to the gum applying rollers, and back on the belt, rendering support of the blank somewhat less than adequate at the gumming station.

SUMMARY OF THE INVENTION

In accordance with the present invention, adequate and continuous support for the envelope blanks are provided at the gumming station while gum is applied periodically along and adjacent to opposed side edges of the envelope blanks prior to the blanks being folded to form an envelope enclosure. The period of application coincides with an envelope blank being disposed beneath one of two spaced, gum applying portions of a gum applying roller.

In accordance with the invention, the gum applying rollers comprise a pair of laterally spaced gum applying dies; each die including a central circular plate and a pair of circular sectors spaced from each other about the circumference of the circular plate. Accordingly, gum is applied to the opposed surfaces or sides of the envelope blank by the sectors only and when the the sectors are adjacent to or directly above the conveyor belt which coincides with the conveying of an envelope blank past the gumming station. No gum can be applied to the belt when a space between the sectors is adjacent to or above the belt, which coincides with the linear spacing of the envelope blanks along the belt.

A shaft is fixed to and extends between the circular plates for rotating the plates and die sectors. A gummer roll means is positioned in the path of rotation of the sectors on each gummer die for contact therewith to effect transfer of glue from the gummer roll to the die sectors.

An adjustment member is fixed to the shaft means for rotation about the shaft means and fixed on the machine at selected points relative thereto to vary the position of the shaft and thus, the amount of force or pressure exerted by the gum roller in contact with the die sectors on the die sectors to vary the amount of gum transferred from the gum roller means to the die sectors. A floating idler gear is provided between gears driving the shaft means carrying both laterally spaced gum applying dies and the gum roller means so that the drive can remain intact regardless of the position of the shaft means carrying the spaced gum applying dies.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
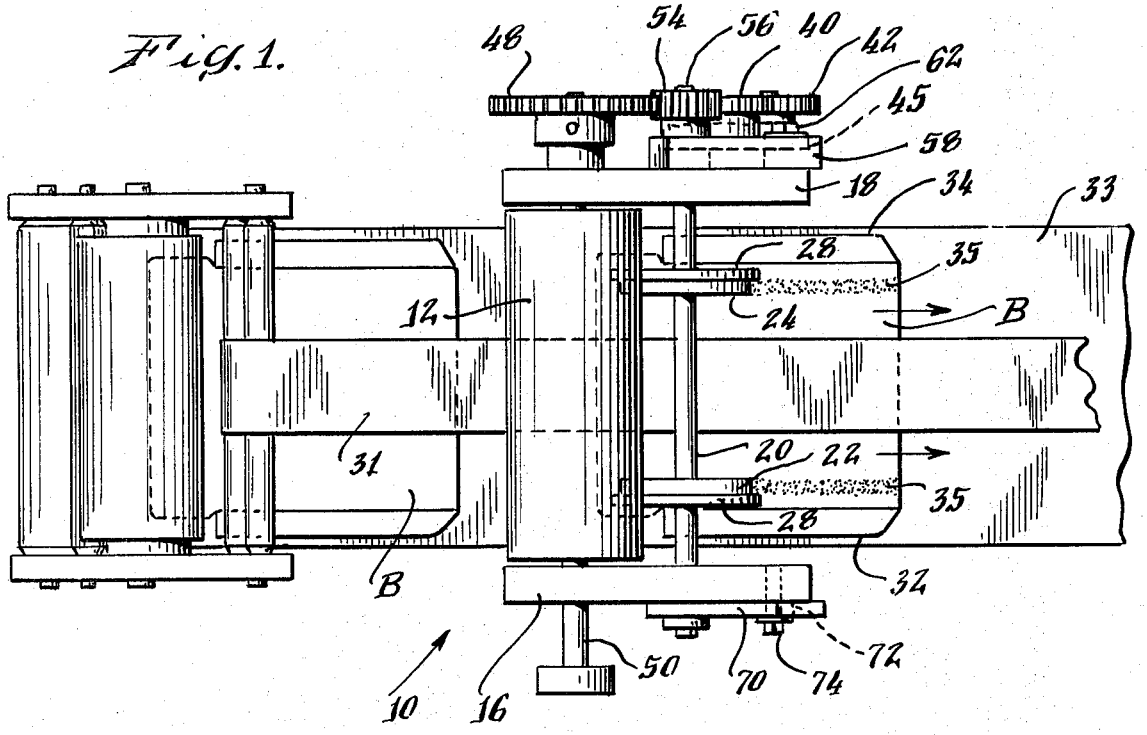
FIG. 1 is a top plan veiw of the gum applying apparatus of the present invention applying gum or adhesive to an envelope blank.
Figure 2:
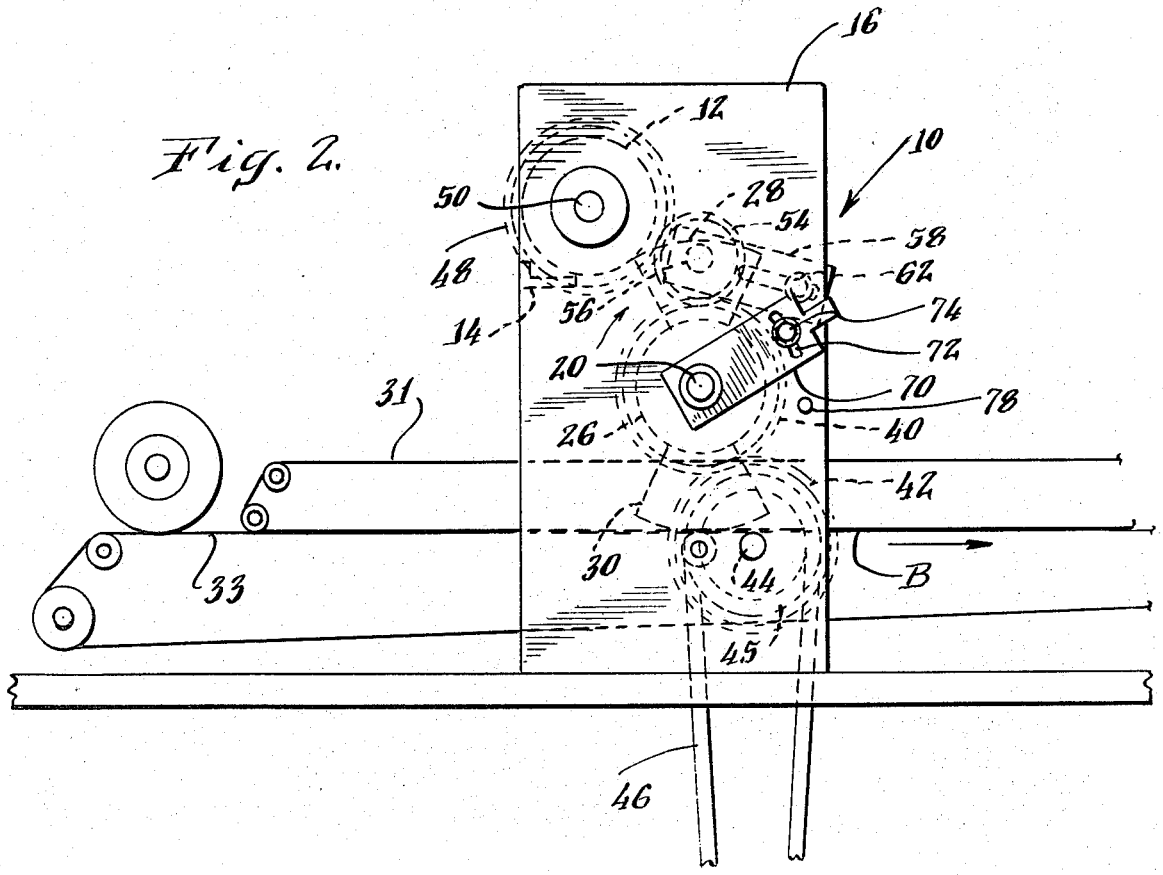
FIG. 2 is a front view in elevation of the apparatus of FIG. 1.
Figure 3:
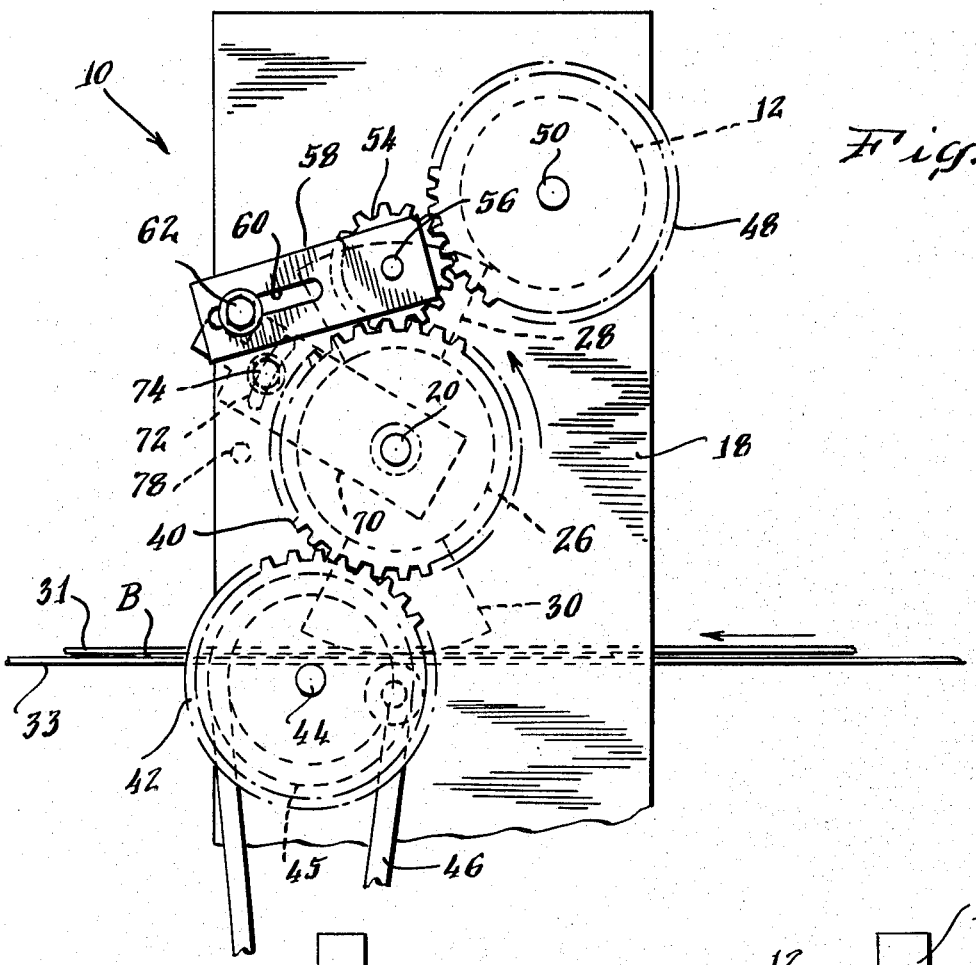
FIG. 3 is an enlarged rear view in elevation of the apparatus of FIG. 1.

Referring now to the drawings in detail, wherein like numerals indicate like elements throughout the several views, the gum applying apparatus 10 of the present invention includes a gummer roll 12 adapted to contact gum or adhesive contained within a container 14 upon rotation of the roll 12.

Mounted between opposite supports 16 and 18 on a shaft 20 are a pair of laterally spaced gum applying dies 22 and 24. Each die includes a central circular plate 26 and a pair of circular sectors 28, 30 spaced from each other about the circumference of each of the circular plates.

Gummer roll 12 is positioned in the path of rotation of each of the sectors 28, 30 on each gum applying die 22, 24 for contact therewith to effect transfer of gum from the gummer roll 12 to the die sectors 28, 30.

As an envelope blank B passes beneath the sectors 28, 30 between a pair of endless conveyor belts 31, 33 gum or adhesive 35 is applied by the die sectors 28, 30 adjacent to and along each side edge 32, 34 of the blank B. Subsequently, the blank edges are folded back upon themselves to form an envelope enclosure.

As indicated in FIG. 1 the envelope blanks B are spaced between each other on the conveyor belt 33. Accordingly, contact with the plane of the blanks B and belt 33 only occurs when the die sectors 28 or 30 are directly above belt 33 adjacent to the envelope blank B. No gum is transferred when the space between the die sectors 28, 30 is adjacent the plane of belt 33. Rotation of shaft 20 is such that the space between the die sectors is adjacent the plane of conveyor belt 34 when the space between the blanks B on belt 33 moves through the gum applying station beneath dies 22 and 24.

Shaft 20 is driven by a gear 40 mounted and fixed on one end of the shaft. A driven gear 42 is in meshing engagement with gear 40 and is mounted on a shaft 44 fixed to a pulley 45 driven by a belt 46 from a suitable motor (not shown). Gum roller 12 is driven by a gear 48 mounted and fixed to a shaft 50 carrying the gum roller.

Gears 40 and 48 are driven in the same direction by having placed in meshing engagement therebetween a gear 54. Idler gear 54 is mounted on a fixed stub shaft 56 on the end of an arm 58 mounted on side support 18 of the apparatus 10. Arm 58 includes an elongated slot 60. A bolt 62 extends through slot 60 whereby the arm 58 can be adjusted reciprocably along the axis of the arm into meshing engagement between the gears 40 and 48. Arm 58 is also pivotably mounted about bolt 62 which connects it to side support 18 of apparatus 10. Accordingly, idler gear 54 is both reciprocably and oscillatably adjustable relative to the driven gears 40 and 48.

An adjustment member 70 in the form of a lever arm is pivotably mounted on shaft 20 carrying the gum applying dies 22 and 24. The member 70 is pivotable on shaft 20 and includes an elongated arcuate slot 72 adapted to receive a bolt 74 therein which can be inserted and tightened into threaded openings 78 in side support 16 to hold the member 70 in one of a plurality of positions relative to the shaft to vary its angle, and thus, the position of the axis of shaft 20. Bolt 74 can be repositioned optionally in various openings 78 to vary the position of shaft 20 as the bolt 74 is loosened and removed in arcuate slot 72.

Figure 4:
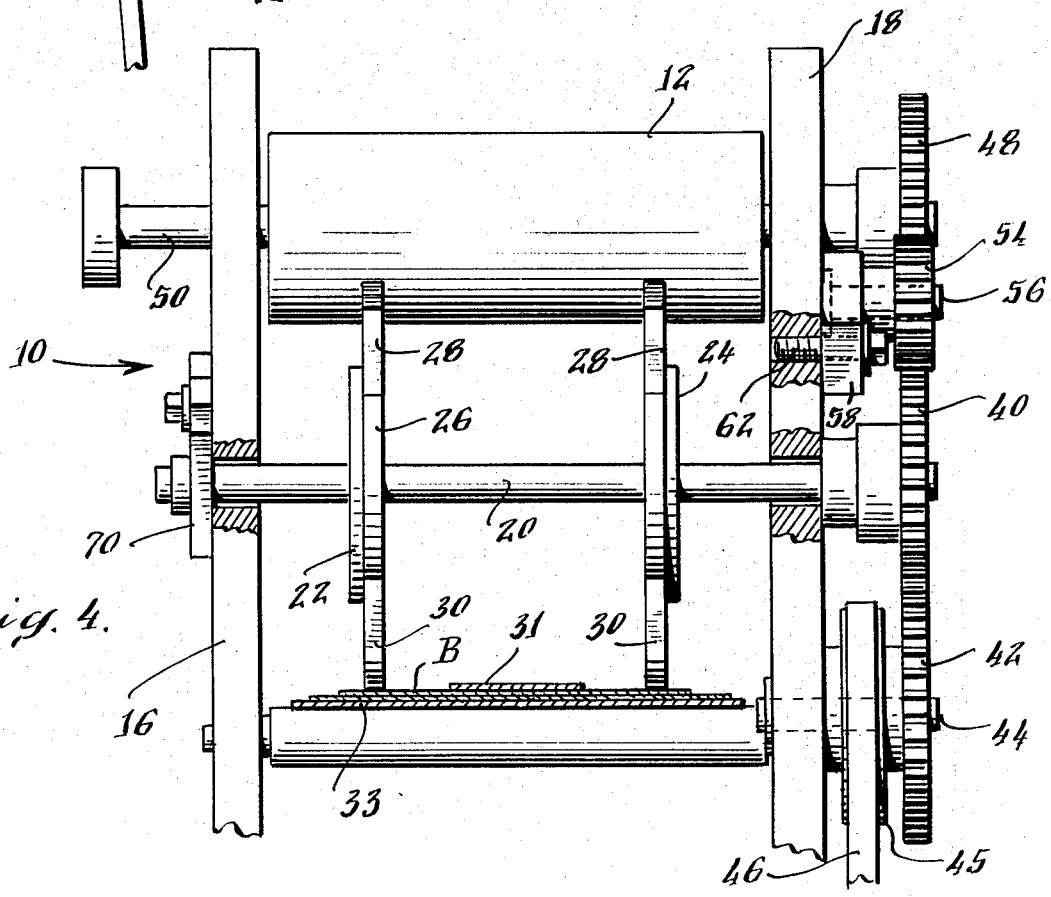
FIG. 4 is an enlarged side view in elevation, partly cut away in section, of the apparatus of FIG. 3, as seen from the left-hand side of FIG. 3.

Adjustment of the member 70 will slightly vary the distance between the axis of shaft 20 and the axis of shaft 50 connected to the gummer roll 12. As shown in FIG. 4, shaft 20 may be inserted through relatively enlarged diameter openings in side supports 16, 18 to enable the shaft 20 to be moved slightly relative to shaft 50 with finer adjustments made by moving arm 70 and slot 72 relative to a fixed position of bolt 74. The movement of shaft 20 relative to shaft 50 will vary the amount of contact force or pressure of the die sectors 28, 30 with the gummer roll 12 and thereby the amount of gum transferred by the gummer roll to the die sectors.

In order to accommodate the increase or decrease of the relative distance of the shaft 20 to shaft 50 of the gum roll means and hence relocation of gear 40 on the end of the shaft, the relative location of idler gear 54 between gears 40 and 48 can be varied by oscillating it about bolt 62 and having the arm 58 moved relative to the bolt 62 towards or away from the gears 40 and 48. This will assure meshing engagement betweeen the drive gears 40, 48 and the idler gear 54 so that both shaft 20 and the shaft 50 fixed to the gum roller 12 are driven together.

What is claimed as new is:

1. Gum applying apparatus comprising:

a pair of laterally spaced gum applying dies, each die including a central circular plate and a pair of circular sectors spaced from each other about the circumference of said circular plate, shaft means fixed to and between said circular plates for rotating said plates and die sectors, gummer roll means positioned in the path of rotation of said sectors on each gummer die for contact therewith to effect transfer of gum from said gummer roll means to said die sectors, gum container means in the path of rotation of said gummer roll means, and drive means operatively connected to said shaft means and gummer roll means for rotating said shaft means and gummer roll means, said drive means including means for adjusting the relative distance of said shaft means to said gummer roll means in order to vary the amount of contact pressure of said die sectors with said gummer roll means and thereby, the amount of gum transferred from said gummer roll means to said die sectors.

2. Apparatus in accordance in with claim 1 wherein said adjustment means includes an adjustment member fixed to said shaft means.

3. Apparatus in accordance with claim 1 wherein said drive means includes gear means fixed to said shaft means and said gummer roll means, and idler gear means in meshing engagement with and between said gear means, said idler gear means being movable in response to adjustment of the distance of said shaft means relative to said gummer roll means so as to maintain the driving connection therebetween.

4. Apparatus in accordance with claim 3 wherein said idler gear means is reciprocably and oscillatably mounted relative to said shaft means and gummer roller means.

5. Apparatus in accordance with claim 2 wherein said adjustment member includes a lever arm pivotably mounted on said shaft means in order to vary the position of the axis of said shaft means, and means for fixing said arm in pivotably adjusted positions on said shaft means.

6. Apparatus in accordance with claim 5 wherein said last named means includes a bolt received through an arcuate slot on the end of said lever arm.

* * * * *